United States Patent [19]

Jenkins

[11] Patent Number: 4,817,725

[45] Date of Patent: Apr. 4, 1989

[54] OIL FIELD CABLE ABRADING SYSTEM

[75] Inventor: Robert L. Jenkins, New Iberia, La.

[73] Assignee: C. "Jerry" Wattigny, a part interest, New Iberia, La.

[21] Appl. No.: 935,589

[22] Filed: Nov. 26, 1986

[51] Int. Cl.[4] ..... E21B 20/04

[52] U.S. Cl. ..... 166/376; 166/54.5; 166/55.8; 166/383

[58] Field of Search ..... 166/54.5, 54.6, 55.8, 166/55.3, 298, 377, 381, 383, 301, 376

[56] References Cited

U.S. PATENT DOCUMENTS

| | | | |
|---|---|---|---|
| Re. 21,824 | 6/1941 | Lowrey | 166/298 |
| 917,555 | 4/1909 | Davin | 166/54.5 |
| 2,284,211 | 5/1942 | Justice | 166/298 |
| 2,328,782 | 9/1943 | Bynum | 166/55.3 |
| 2,495,953 | 1/1950 | Anotin | 166/54.5 |
| 2,859,943 | 11/1958 | Chadderdon | 166/55.8 |
| 3,378,072 | 4/1968 | Smith | 166/298 |
| 3,419,077 | 12/1968 | Sanford | 166/55.8 |
| 4,068,711 | 1/1978 | Aulenbacher | 166/55.3 |
| 4,144,936 | 3/1979 | Evans | 166/298 |
| 4,646,826 | 3/1987 | Bailey et al. | 166/55.3 |

*Primary Examiner*—Hoang C. Dang
*Attorney, Agent, or Firm*—C. Emmett Pugh

[57] ABSTRACT

A down-hole oil field cable abrader having an elongated abrading head pivotally connected at one of its ends to a body attachable to a tubing string. An abrading portion extends axially along the abrading head from its pivotal connection and includes a plurality of abrading elements, similar to the cutting elements on a drill bit, spiralling axially about the abrading head ending in a taper to an area distal to its pivotal connection. The body includes an open interior communicating with an interior of the string and a piston slidably disposed in its open interior for longitudinal movement within the body under the pressure of a fluid in the interior of the tubing string to a position in which a cam ear included with the abrading head and which is positioned to be engaged by the piston may translate the force from the pressure of the fluid, as the pressure moves the piston, into a radial force to bias the abrading head radially outward to a position suitable for cyclically contacting and abrading a cable located downhole outside the tubing string and alongside the abrading head. In use the abrading head is continuously rotated, causing the cable to become spirally wrapped at least partially around the abrading elements and dragged along the abrading elements, cyclically abrading the cable as the abrading head rotates, until the cable is ultimately severed after a sufficient number of passes have occurred.

22 Claims, 5 Drawing Sheets

OIL FIELD CABLE ABRADING SYSTEM

BACKGROUND OF THE INVENTION

1. Field of the Invention

The present invention relates to oil field tools, and in particular to an abrading tool used down in the hole or well; and more particularly to a tool for abrading a cable or other similar item positioned on the exterior of a well tubing located down in the hole of the well, usually within an exterior well casing, so that the cable may be severed.

2. Prior Art and General Background

In the oil field oil wells are drilled deeply down into the ground. Typically a casing is included to form an interior steel wall for the hole. Within the hole long lengths of primary tubing are lowered during various times as needed during the drilling or operation of the well.

In particular, many long lengths of tubing, made up of individual sections, are lowered down into the hole with some exterior material, such as for example a cable wrapped along its exterior, usually extending down to the bottom end portion of the tubing. In certain circumstances, the major length of the tubing needs to be withdrawn, while the very bottom, end portion is cut away and at least temporarily left down in the hole. This may occur for example when a packer or electric pump down toward the end of the tubing gets lodged or stuck in the hole.

A problem arises in such a situation due to the cable extending down and being attached to the portion of the tubing to be left in the hole. In order to withdraw the greater length of the tubing, the cable needs to be broken or otherwise severed in order to allow such withdrawal. If the upper tool portion is merely pulled up until the cable snaps or breaks somewhere along its length, which for example could occur many feet above the "abandoned" lower section of the tubing, a big pile of cabling then falls down on top of the "abandoned" section, blocking access to it and causing a difficult problem should thereafter one desire to remove or retrieve the "abandoned" section by jarring or forcible pulling it loose.

In general, an attempt to cut the cable by using a suitable casing cutter is not successful due to the difference in cutting a relatively loose cable, as compared to cutting rigid, fixed casing, which may be cut by a blade striking an arc along the inside of the casing or concentric tubing as the blade is positioned radially outward and rotated. As may be appreciated, with casing or tubing the blade may not be moved radially outward a radial distance further than the interior wall of the tubing or casing, resulting in the cutting tip of the blade having a correct position for cutting the casing or tubing. However, with a flexible, relatively loose cable, the cutting tip would generally be extended radially past the cable. When the casing cutter is rotated, this results in the blade bumping into the cable and then refusing to rotate due to blocking by the cable, or, if the rotating torque is high enough, putting the cable in high tension and causing the cable to eventually snap, which may occur anywhere along its length.

Applicant knows of no suitable tool which may be used for cutting cable down-hole. Accordingly, the present invention is directed to an oil field cable abrader which can be lowered down within the tubing down to the area where the tubing has been cut by other suitable means, and which may then be used to sever the exposed cable on the exterior of the primary tubing by abrading the cable. In order that abrading may occur, the cable abrader of the present invention provides a spiraling abrasive path over which the cable may be drawn as the cable abrader is rotated until the cable is severed, allowing the primary tubing to be then withdrawn without interference from the cable or leaving a large amount of cabling on top of the bottom end portion of the tubing left in the hole.

3. General Discussion of the Invention

It is thus a basic object of the present invention to provide a safe, reliable, economical, practical tool for abrading cable or other such material on the exterior of a tubing substantially down in the hole, typically with a tool which in a series of either rotational (preferred) or longitudinal passes ultimately severs the cable.

The present invention in its preferred embodiment achieves these goals by utilizing a basic abrading body located at the end of a smaller diameter tubing which is lowered down within the interior of a primary tubing which may be concentrically located within a casing. The abrading body includes an abrading head (with spirally located abrading elements) pivotally connected to the lower end of the tool body, which abrading head hangs down in a vertical disposition due to its own weight as the abrading tool is lowered into the primary tubing.

However, when the abrading tool of the invention reaches the area where the exterior cable is exposed, fluid pressure from the surface is used to push down a piston slidably disposed within the interior of the abrading body, causing the abrading head to be pivoted laterally out about its pivotal connection to a position suitable to make contact with the exposed, exterior cable.

The tool is then rotated about a vertical axis causing the abrading head to cyclically abrade and, after a sufficient number of passes, sever the cable. The present invention accomplishes this by wrapping the cable at least partially around an abrading portion on the head, which portion spirals about the abrading head to provide a curved path on the abrading head over which the cable is drawn or dragged and abraded cyclically until the cable is ultimately severed.

Upon completion of the job, the interior fluid pressure is relieved, causing the abrading head under its own weight to return back down to its retracted, vertical disposition, allowing the abrading tool of the present invention and its smaller diameter tubing to be withdrawn out of the primary tubing and the hole.

With the severance of the exterior cable, the upper, main length of the primary tubing with the severed portion of the cable wrapped around it or otherwise attached to it can then likewise be withdrawn up out of the hole, leaving the other, relatively short severed portion of the cable down in the hole with its attendant element(s).

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DESCRIPTION OF THE PREFERRED, EXEMPLARY EMBODIMENTS

Figure 1:
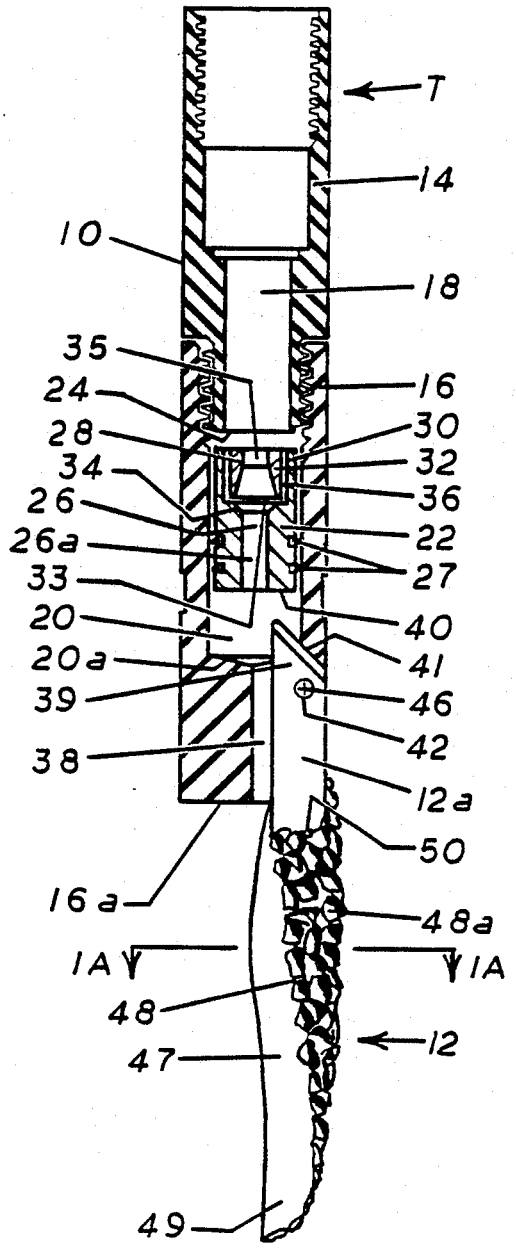
FIG. 1 is a cross-sectional view of a preferred embodiment of an abrading tool according to the present invention having an abrading head pivotally connected to its body, with the abrading head shown in a vertical, retracted position suitable for lowering in the interior of a primary tubing.
Figure 2:
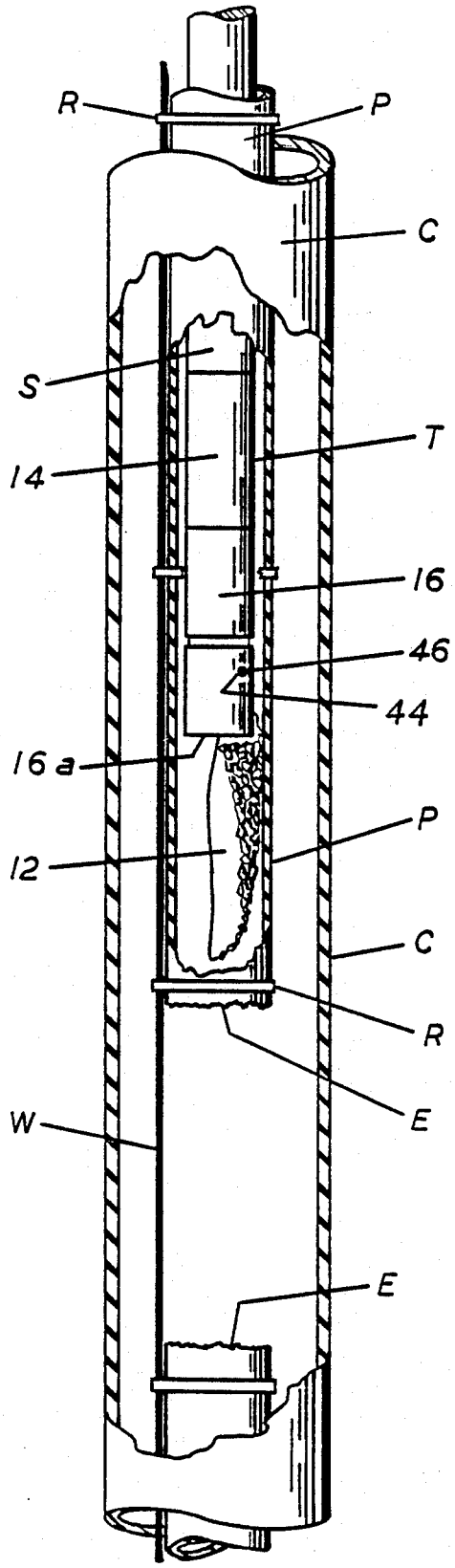
FIG. 2 is a partly sectional, side view of the embodiment of the abrading tool shown in FIG. 1, with the abrading tool shown lowered inside a primary tubing string which is located inside a casing.
Figure 4:
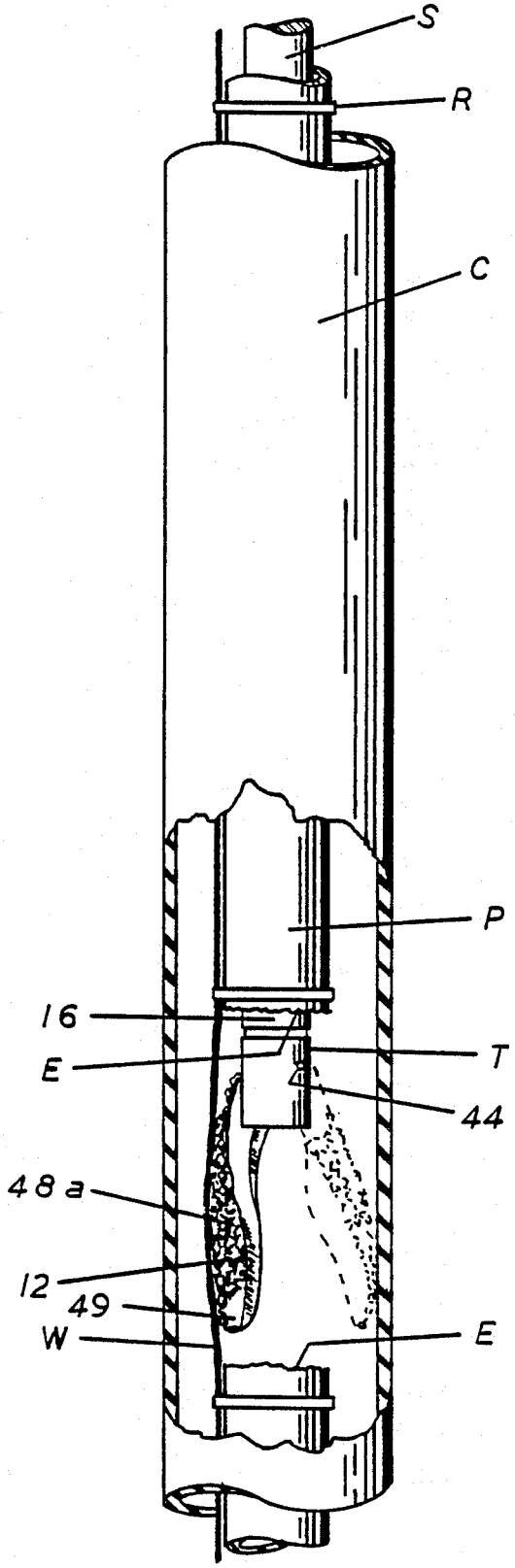
FIG. 4 is a side view of a primary tubing concentrically located in a casing in the well bore having a cable attached generally peripherally thereto, with the casing shown partially cut away to reveal the preferred embodiment of the cable abrader of the present invention shown in FIG. 1 but positioned between the cut ends of the primary tubing and biased outward to a position in which the cable is at least partially wrapped around an abrading portion included with the abrading head which is suitable for abrading the cable so that the cable may be severed.
Figure 6C:
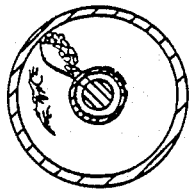
FIGS. 6A, 6B and 6C are cross-sectional views taken along a horizontal line of FIGS. 5A, 5B and 5C, respectively.
Figure 6B:
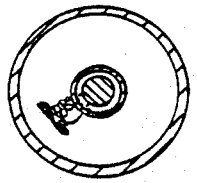

Referring to FIG. 1, a preferred, exemplary embodiment of an abrading tool T according to the present invention is seen. The tool T includes an elongated cylindrical body 10 and an abrading head 12 pivotally connected to the lower end of body 10, with the body 10 being adapted to be attachable to a tool string S, as best seen in FIGS. 2 and 4. The tool T is a preferred form of a cable abrader for severing cable or a similar item on the exterior of a tubing in a well bore and is adapted to be lowered into the well bore within a series of tubing members, which may include a primary tubing P and which is usually located in a well casing C.

The body 10 of tool T includes an upper housing 14 having internal threads, which are adapted to receive the drill string S, and a lower main body portion or lower housing 16, which is threadably attached to the lower end of housing 14. Housing 14 includes a central passage 18 for communicating fluid from the interior of the tool string S to a central longitudinal bore 20 in housing 16, with passage 18 and bore 20 defining an open interior or passageway in body 10 in communication with the interior of the drill string S through which fluid may be circulated downwardly from the tool string S in the usual manner.

A piston means in the form of a floating piston 22 is disposed in bore 20 of the open interior and is adapted to slide therein. As may be appreciated, housing 14 includes an annular shoulder 24 which prevents further upward movement of piston 22 into central passage 18 and, as bore 20 terminates in end **20*a*, further downward movement of piston 22 past end 20a and out of the tool T is prevented. Accordingly, piston 22 is movable from a first position, as shown in FIG. 1, in which its annular upper surface is in abutment with annular shoulder 24 to a second position in which its lower abutment is in abutment with end 20a**, for purposes which will be described in detail later.

Piston 22 includes a passageway 26 for communicating fluid therethrough from the upper end of bore 20 to its lower end, allowing the interior of the tool string S to be communicated with the interior body 10 below piston 22 to define a passage through which the fluid may be circulated downwardly from the tool string S. As may be appreciated, the cylindrical wall of piston 22 includes annular grooves, in which O-rings 27 are positioned to form a liquid-tight seal between the piston 22 and the bore 20.

A restricting means in the form of an orifice is included in passageway 26 to create a restriction to the flow of fluid through the interior of piston 22, allowing a pressure above piston 22 to be greater than a pressure below the restricting means, in order to cause piston 22 to move longitudinally downward by the pressure of the fluid in the interior of the tool string T from its first position to its second position, for purposes which will be described in detail later. Accordingly, piston 22 may be seen as providing a piston means slidably disposed in the open interior of body 10, which is longitudinally movable within body 10 from a first position to a second position for purposes which will be described in detail later by the pressure of a fluid in the interior of the tool string S.

As may be appreciated, the orifice may be a removable jet nozzle 28 or pressure choke for allowing the pressure from the fluid in the string S to be selectively adjusted. Accordingly, passageway 26 may include a bored portion 30, which is axially bored to a larger diameter than the lower portion **26*a* of passageway 26, in which nozzle 28 may be removably positioned, and nozzle 28 may include a cylindrical body 32 which is inserted into bored portion 30 with its lower surface 33 in abutment with an upper annular surface 34 surrounding the lower portion of passageway 26**.

As may be appreciated, nozzle 28 is preferably provided in an interchangeable series having a jet 35 of differing sizes to allow the pressure to be selectively adjusted. Accordingly, suitable diameters for the jet 35 may be, for example, one-eighth inch, one-quarter inch, one-half, and three-quarters inch, etc., with the selected size depending on the amount and characteristics of the fluid being moved in the string S above the tool T through the jet 35.

In order to restrain fluid from bypassing nozzle 28, bored portion 30 is provided with an annular groove, in which an O-ring 36 is positioned for sealing engagement between bored portion 30 and nozzle 28.

A longitudinal slot 38 extends radially inward from the lower end of housing 16, with its longitudinal length aligned with the axis of housing 16. Slot 38 further has its longitudinal length running the length from the bottom 16*a* of housing 16 to end 20*a*, so that it may intersect with bore 20 in order to allow communication between bore 20 and the annular space surrounding the tool T, and, as may be appreciated, forms a portion of the open interior, so fluid may be circulated downwardly from the tool string S and out slot 38 to the space surrounding the tool T. Accordingly, slot 38 extends radially inward so that an opening may exist between bore 20 and slot 38 for communication therebetween.

Pivotally positioned in slot 38 is abrading head 12. Abrading head 12 has a generally elongated shape and has one of its ends pivotally connected to body 10, as previously mentioned, near the lower end of housing 16. The head 12 includes a translating means for translating a portion of the longitudinal force generated by the fluid, as piston 22 moves to its second position, into a radial force to bias abrading head 12 radially outward from a first position, as shown in FIG. 1. In this initial position, the abrading head 12 has its longitudinal axis substantially parallel to the axis of the tool string S, but then is moved to a second position, as best shown in FIG. 3, suitable for abrading a cable located down-hole outside the tool string S and alongside the abrading head 12, so that the cable may be severed, as will be described in detail below.

Figure 3:
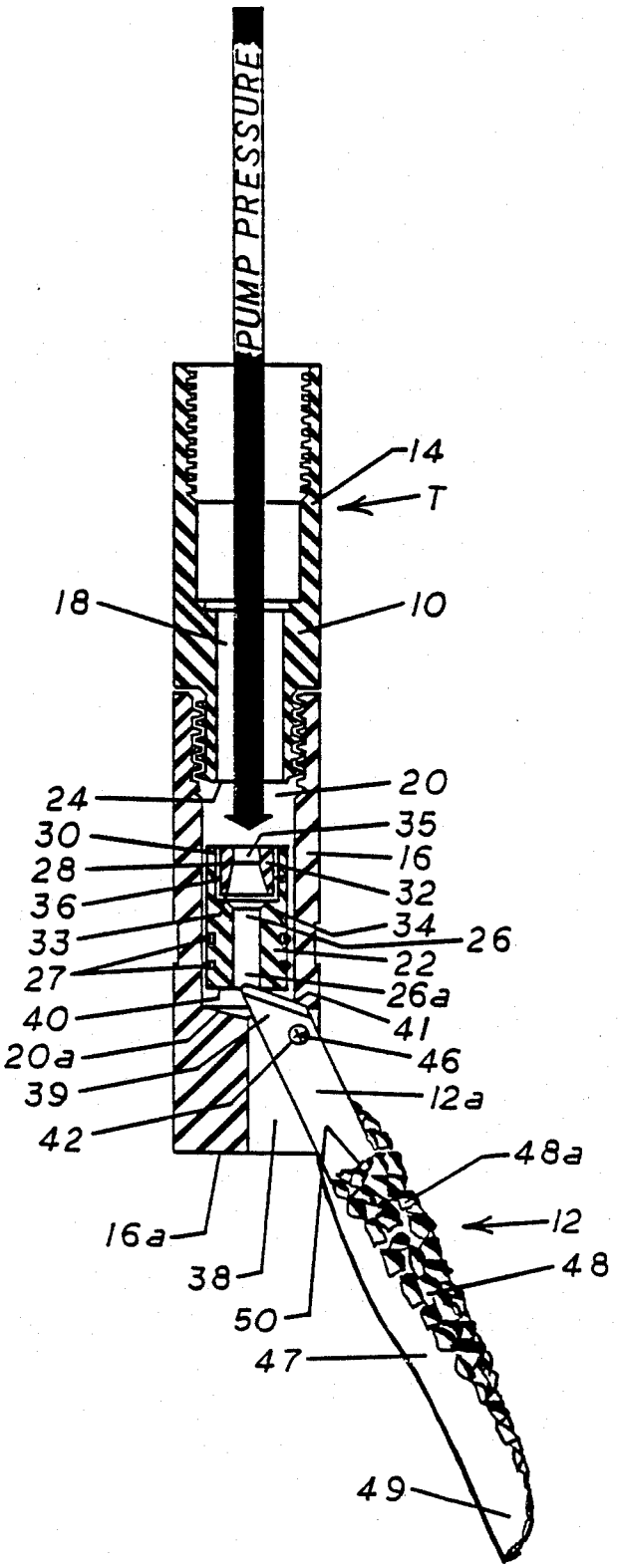
FIG. 3 is a cross-sectional view of the preferred embodiment of an abrading tool according to the present invention as shown in FIG. 1 with its abrading head shown biased radially outward to a position suitable for abrading a cable located down-hole so that the cable may be severed.

As shown in the figures, the translating means may include a cam ear 39 positioned to be engaged by a downwardly facing, annular actuating face 40 included with piston 22 as it moves to its second position for translating a portion of the longitudinal force into a radial force to bias abrading head 12 radially outward as shown in FIG. 3. As shown in the figures, the cam ear 39 may include a flat shank portion 12*a* having an end which includes an angular face 41 which is engaged by actuating face 40 as piston 22 moves downwardly to its second position. As actuating face 40 contacts cam ear 39, angular face 41 allows abrading head 12 to rotate and translates the longitudinal force into a radial force to bias abrading head 12 radially outward as previously mentioned.

The abrading head 12 is pivotally connected to body 10 as previously mentioned. Accordingly, a suitable bore 42 is positioned in portion 12*a* a distance from the longitudinal axis of abrading head 12 to allow the abrading head 12 to be pivotally connected off center, and the shank portion 12*a* of the abrading head 12 is inserted upward into slot 38 with bore 42 aligned with a pair of lateral, opposed bores 44, best seen in FIGS. 2 and 4. The lateral, opposed bores 44 are provided in housing 16 by a suitable means such as drilling and are located a radial distance from the axis of body 10, and positioned near the perimeter of body 10. A laterally extending pivot means in the form of a pin 46 is inserted through one side of the lateral, opposed bores 44, through bore 42 and into the opposite bore 44 and is held therein by suitable means such as a force fit in bores 44.

As may be appreciated, bore 42 and pin 46 have suitable dimensions so that abrading head 12 may pivot on pin 46 in slot 38. Accordingly, flat portion 12*a* has a suitable length, sot hat the abrading portion of abrading head 12 may rotate radially outward freely without interference from slot 38.

Figure 1A:
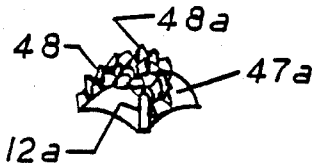
FIG. 1A is a cross-sectional view of an abrading head according to the present invention taken along the cut lines 1A of FIG. 1.

As mentioned, abrading head 12 is pivotally connected to body 10 a radial distance from the axis of body 10, with pin 46 offset to one side of the longitudinal center line of body 10 and has a natural or inherent tendency to stay in a retracted or vertical configuration under the force of gravity, unless forced out of it by an exteriorly applied force from piston 22.

extending axially along abrading head 12 from the flat, shank portion 12*a* of abrading head 12 is an elongated blade 47. The blade 47 includes a lateral, curved surface 47*a*, as best seen in FIG. 1A, having an abrading portion 48. The abrading portion 48 includes a plurality abrading elements 48*a*, which are generally irregular in shape and which may be for example tungsten carbide, tool steel or diamond cutting or abrading elements to provide a sharp, durable abrading face, similar to the cutting surfaces on a drill bit. The abrading elements 48*a*, as shown in the figures, may have a shape which may be described as knobby or diamond-like, with each abrading element generally in abutment with its neighboring elements. The abrading elements 48*a* extend outward from the lateral, curved surface 47*a* of the blade 47 of the abrading head 12 and spiral axially about the lateral, curved surface 47*a* of abrading head 12 and taper to an area 49 distal to the pivotal connection of its end or shank portion 12*a* to body 10. As may be appreciated, abrading elements 48a may be described as tapering in a direction outward from tool T to a point, and, as shown in the figures, may have a single spiral from a position 509 on abrading head 12 near shank 12*a* on abrading portion 48, which spirals along the lateral, curved surface 47*a* of blade 47 about the axis of abrading head 12 and tapers outward to an area 49 distal to the pivotal connection of shank portion 12*a* to said body 10, which may be a point on the opposite side of abrading portion 48.

In a preferred use of the present invention, a nozzle 28 is selected having a suitable jet 35 for the amount of characteristics of the fluid to be moved in the string S above the tool T and through the jet 35. The nozzle 28 is positioned in bored portion 30 as previously discussed, and the cable abrader or abrading tool T is attached to the lower end of the tool string S with the abrading head 12 in its first position, generally vertical positioned aligned with the longitudinal axis of the tool string S and lowered as known to the art into a well bore. In general, the well bore includes a casing C and a primary tubing string P having a cable W disposed down-hole generally coaxial thereon, and attached in a conventional manner, such as by spaced annular attachment rings R, as best seen in FIGS. 2 and 4, spaced along the length of tubing string P.

The primary tubing P, as best seen in FIGS. 2 and 4, has been previously cut, as indicated in the figures, by a suitable casing cutter or by other means as known to the art, which has left the cable W uncut. Accordingly, the abrading tool T is lowered to the proper depth, as best shown in FIGS. 4 and 5A–5C, and positioned between the cut ends E of the primary tubing string P by adjusting the length of the tool string S between, for example, a swivel assembly, not illustrated, located adjacent to the upper end of the casing C and the abrading tool T, as explained in some detail in U.S. Pat. Nos. 3,301,324 and 3,378,072.

Figure 5C:
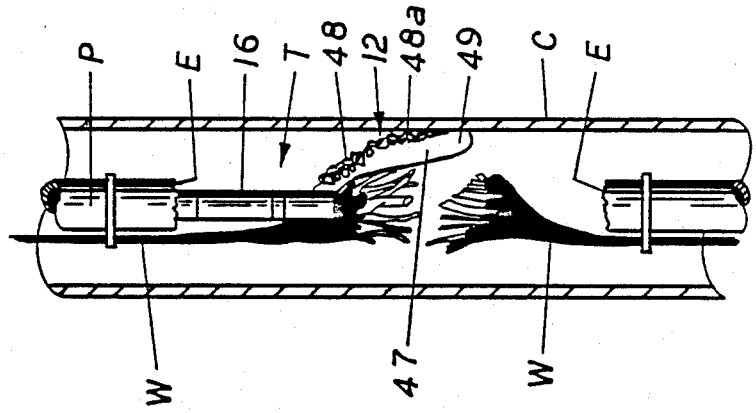
FIG. 5C is a cross-sectional view of the preferred embodiment of the cable abrader of the present invention shown in FIG. 1, with the cable shown severed by the cyclic rotation of the abrading head.
Figure 5B:
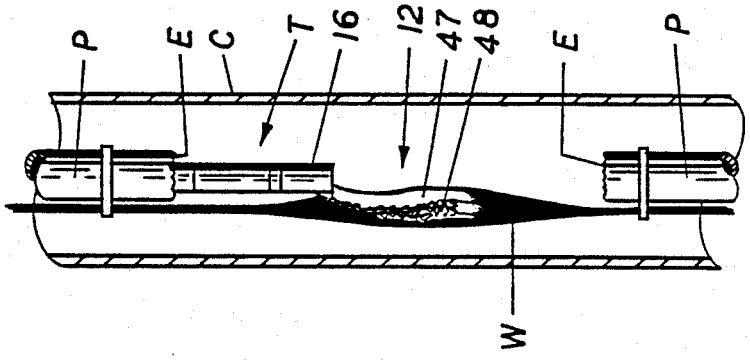
FIG. 5B is a cross-sectional view of the preferred embodiment of the cable abrader of the present invention shown in FIG. 1 but rotated to a further position in which the cable is at least partially wrapped around an abrading portion included on the abrading head that is suitable for abrading the cable so that the cable may be severed.
Figure 6A:
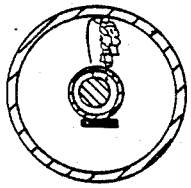
Figure 5A:
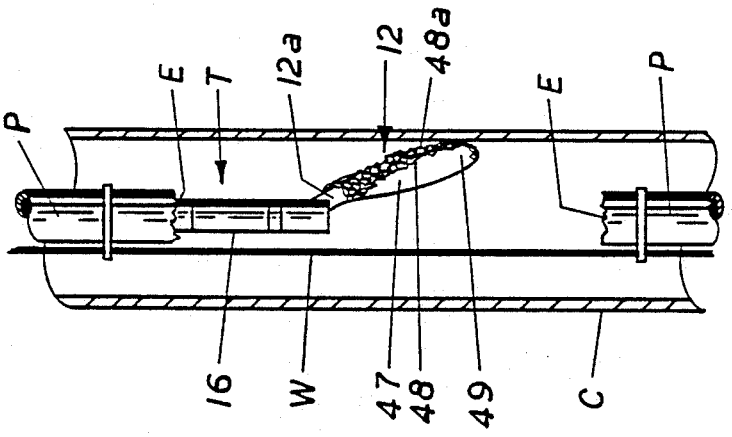
FIG. 5A is a cross-sectional view of the preferred embodiment of the cable abrader of the present invention shown in FIG. 1 positioned between the cut ends of the primary tubing and biased outward to a position suitable for abrading the cable so that the cable may be severed.

With the abrading tool T suitably positioned, a suitable hydraulic fluid is circulated downwardly through the tool string S against the piston 22, and the pressure raised so as to move piston 22 from its first upper position downward to its second position as shown in FIG. 3. As piston 22 is moved to its second position, the fluid pressure is translated into a radial force to bias the abrading head 12 outward to an extended position, as shown in FIG. 5A. Accordingly, as piston 22 moves downwardly, its actuating face engages cam ear 39 and translates the longitudinal force of piston 22 into a radial force to bias the abrading head 12 radially outward, allowing the abrading head 12 to pivot on pin 46 to its second position generally radially outward from the abrading tool T. The head 12 is preferably separated by a suitable distance from the interior wall of the casing C, so that it may be rotated without interference therefrom, as seen for example in FIGS. 4 and 5A, suitable for abrading cable W, located down-hole outside the primary tubing string P and alongside the abrading head 12, so that the cable W is ultimately severed.

Accordingly, the abrading portion 48 included with the abrading head 12 is biased radially outward, and the abrading elements 48*a*, which spiral axially about the abrading head 12, are biased into a position suitable for abrading the cable W, so that the cable W may be ultimately severed after a sufficient number of cyclically passes takes place.

With the abrading head 12 continuously biased outward to its second position by the fluid pressure, the tool string S is rotated by a suitable rotary table, or other suitable equipment which may be available, and such rotation of the tool string S causes the abrading tool T to be rotated within the inner casing C. This rotational movement of the abrading tool T causes the abrading head 12 to be rotated to a further position, as shown in FIGS. 5A, 5B in which the abrading portion 48 contacts the cable W. When the abrading head 12 has assumed its further position, cable W will be biased or deflected laterally by the rotation of the abrading head 12 and its abrading elements 48*a* in a direction along the path in which the abrading head 12 rotates. As best seen in FIGS. 4 and 5B, this causes the cable W to become wrapped at least partially around the abrading head 12 in a spiral, curved path, further causing the cable W to be abradingly dragged across the abrading elements 48*a* as the cutter head 12 continues to be rotated.

As the abrading head 12 is rotated, the abrading elements 48*a* are rotated in an arc and cyclically brushed abrasively a number of times against the cable W, as it is caused to move along its curved path across the abrading elements 48*a* during a part of each cycle. Further, with each rotation of the abrading tool T the cable W will be deflected as mentioned to its position in which the cable W is wrapped at least partially around the abrading head 12, and, as the abrading head 12 is rotated thereby, the cable W will be cyclically brushed and abraded by drawing a portion of its length across the curved path and along a portion of the abrading elements 48*a*, and then released until the next cyclical contact and abrading wrap.

In addition, and alternatively, when the abrading head 12 has been continually biased outward by the fluid pressure and with the abrading portion 48 in suitable contact with the cable W to deflect its position, the tool string S may be moved longitudinally in the well, so that the cable W may be abraded by drawing a portion of its length longitudinally along the curved path and along a portion of the abrading elements 48*a*, until the cable W is ultimately severed. However, the cyclical rotation of the tool T currently is preferred.

Upon completion of the abrading or severing of cable W, which may be indicated by a drop or reduction in the torque necessary to turn the tool string S a complete three hundred and sixty degrees, the tool string S may be removed from the well bore and that portion of the tool string S between the aforementioned swivel assembly and the abrading tool T broken down and disassembled.

The abrading tool 10 may be, and as shown is, constructed with a fluid bypass, which allows the fluid driving the piston 22 downward to be bypassed or bled off by means of slot 38.

In a further preferred embodiment of the abrading head of the present invention, the abrading head may include, for example, a cam ear having an arcuate face, which is engaged by actuating face 40 as the piston 22 moves downwardly to its second position, to allow the abrading head 12 to rotate and translate the longitudinal force into a radial force to bias abrading head 12 radially outward, as previously mentioned.

The foregoing disclosure and description of the invention is illustrative and explanatory thereof, and various changes in the method steps as well as in the details of the illustrated and described apparatus may be made within the scope of the claims without departing from the spirit of the invention.

What is claimed is:

1. A down-hole, oil field cable abrader, comprising:
   - a body attachable to a tubing string having an open interior which communicates with an interior of the tubing string;
   - an elongated abrading head having an end pivotally connected to said body;
   - an abrading portion extending axially along said head from said end pivotally connected to said body, said abrading portion including
   - a plurality of abrading elements which spiral axially about said abrading head and taper to an area distal said end pivotally connected to said body;
   - piston means slidably disposed in said open interior for longitudinal movement within said body from a first position to a second position by the pressure of a fluid in the interior of the tubing string;
   - translating means included with said abrading head for translating a portion of the longitudinal force generated by the fluid as said piston means moves to said second position into a radial force to bias said abrading head radially outward from a first position in which said abrading head has its longitudinal axis generally parallel to the axis of the tubing string to a second position suitable for abrading a cable located down-hole outside the tubing string and alongside said abrading head; and
   - rotating means connected to the tubing string for rotating said abrading head when biased to said second position to a further position in which the cable is wrapped at least partially around said abrading head to abrade the cable as said abrading head rotates, severing the cable after a multiple number of passes.

2. The cable abrader of claim 1, wherein the cable is wrapped at least partially around said abrading head to provide a curved path for the cable across said abrading elements.

3. The cable abrader of claim 1, wherein said end of said abrading head is pivotally connected by a laterally extending pivot means to said body a radial distance from the axis of said body.

4. The cable abrader of claim 3, wherein said pivot means is positioned near the perimeter of said body.

5. The cable abrader of claim 1, wherein said translating means includes a cam ear positioned to be engaged by a downwardly facing, annular actuating face included with said piston means as it moves to said second position for translating a portion of the longitudinal force into a radial force to bias said abrading head radially outward.

6. The cable abrader of claim 1, wherein said piston means includes a passageway for communicating the interior of the tubing string with the interior of said body below said piston means to define a passage through which the fluid may be circulated downwardly from the tubing string.

7. The cable abrader of claim 6, wherein there is further included a restricting means in said passageway to restrict fluid flow therethrough so that a pressure above said piston means is greater than a pressure below said restricting means in order to cause said piston means to move from said first position to said second position.

8. The cable abrader of claim 7, wherein said restricting means is an orifice.

9. The cable abrader of claim 8, wherein said orifice is a removable jet nozzle for allowing the pressure from the fluid in the tubing string to be selectively adjusted.

10. The cable abrader of claim 9, wherein said passageway of said piston means includes a bored portion in which said nozzle is removably positioned, and wherein said nozzle includes a cylindrical body which is inserted into said bored portion.

11. The cable abrader of claim 1, wherein said abrading head includes an elongated blade portion extending axially from said end pivotally connected to said body and having a lateral, curved surface which includes said abrading portion.

12. The cable abrader of claim 11, wherein said lateral, curved surface is movable radially outward by said translating means to a position suitable for rotation having said lateral, curved surface substantially perpendicular to its path of rotation.

13. The cable abrader of claim 11, wherein said abrading elements have a form of a single spiral from a position on said abrading head near said end pivotally connected to said body, which spirals along said lateral, curved surface about the axis of said abrading head and tapers to said area distal said end pivotally connected to said body on an opposite side of said abrading head.

14. The cable abrader of claim 13, wherein said abrading elements are irregular in shape.

15. The cable abrader of claim 14, wherein said abrading elements have a diamond like shape, with each of said elements generally in abutment with its neighboring elements.

16. The cable abrader of claim 1, wherein the tubing string is a tool string.

17. The cable abrader of claim 1, wherein there is further included, after said abrading head has assumed said further position, longitudinal movement means for longitudinal movement of the string for abrading the cable, the cable being ultimately severed by cyclically drawing a portion of its length longitudinally along a curved path provided by the wrapping of the cable at least partially around said abrading elements and along a portion of said abrading elements.

18. A method of abrading a cable located substantially down-hole within a well bore between the well bore and a smaller, at least generally concentric tubular member, comprising the steps of:

(a) lowering a tubing string having an extendable cable abrading portion attached thereto into the well bore which has the cable to be severed located in the well bore substantially down-hole, said abrading portion having a plurality of abrading elements that spiral axially about an abrading head included with said abrading portion, until said abrading portion is located substantially down-hole adjacent the area of the cable to be severed;

(b) moving said abrading portion into contact with the cable and further moving it against the cable, causing the cable to be cyclically wrapped at least partially around said abrading elements by the movement of said abrading elements to provide a curved path for the cable across said abrading elements, and still further moving said abrading portion until it is moved past and out of contact with the cable, after the cable was drawn across said abrading elements; and (c) cyclically moving said abrading elements against the cable a multiple number of times to abrade the cable as it is drawn over said abrading elements until the cable is ultimately severed by the repetitive abrading action.

19. The method of claim 18, wherein there is further included the step of having said abrading elements located in a spiral about said abrading portion; and wherein said abrading portion is continuously rotated about a vertical axis, causing said cable to cyclically, spirally wrapped about and drawn against said spirally located abrading elements.

20. A method of abrading a cable, comprising the steps of:

lowering a tubing string having a cable abrader attached thereto into a well bore;

raising a fluid pressure in the tubing string and translating the fluid pressure into a radial force to bias an abrading portion, said abrading portion having a plurality of abrading elements that spiral axially about an abrading head included with said cable abrader, radially outward;

rotating said abrading elements in an arc to abrade a cable located down-hole outside the tubing string and alongside said abrading head;

wrapping the cable at least partially around said abrading elements by the rotation of said abrading elements to provide a curved path for the cable across said abrading elements; and abrading the cable by drawing a portion of its length along said curved path and across at least a portion of said abrading elements until the cable is severed.

21. The method of claim 20, wherein the step of abrading the cable includes the step of moving the tubing longitudinally for abrading the cable so that the cable may be cut by drawing a portion of its length longitudinally along said curved path and along a portion of said abrading elements.

22. The method of claim 20, wherein the step of abrading the cable includes the step of cyclically rotating the tubing string continuously about a vertical axis for abrading the cable until the cable is severed by cyclically drawing a portion of its length along said curved path and along a portion of said abrading elements and then releasing until the next cyclical contact.

* * * * *